US010464225B1

(12) United States Patent
Morales

(10) Patent No.: US 10,464,225 B1
(45) Date of Patent: Nov. 5, 2019

(54) SHAVING RAZOR

(71) Applicant: Lizzette Morales, Attleboro, MA (US)

(72) Inventor: Lizzette Morales, Attleboro, MA (US)

( * ) Notice: Subject to any disclaimer, the term of this patent is extended or adjusted under 35 U.S.C. 154(b) by 0 days.

(21) Appl. No.: 15/979,593

(22) Filed: May 15, 2018

(51) Int. Cl.
*B26B 19/44* (2006.01)
*B26B 19/38* (2006.01)
*B26B 19/04* (2006.01)

(52) U.S. Cl.
CPC ..... *B26B 19/44* (2013.01); *B26B 19/04* (2013.01); *B26B 19/3873* (2013.01); *B26B 19/3886* (2013.01)

(58) Field of Classification Search
CPC ..... B26B 19/40; B26B 19/44; B26B 19/3873; B26B 19/3886
USPC ..... 30/41.5, 41.6
See application file for complete search history.

(56) References Cited

U.S. PATENT DOCUMENTS 2,802,260 A * 8/1957 Allen ..... B26B 19/44 30/133
3,103,744 A * 9/1963 Kobler ..... B26B 19/38 30/346.51
3,295,204 A * 1/1967 Brophy ..... B26B 19/3813 15/405
3,417,468 A 12/1968 Hideo
4,205,441 A * 6/1980 Turner ..... B26B 21/446 30/41.5
5,121,541 A * 6/1992 Patrakis ..... B26B 19/40 30/34.05
5,673,485 A * 10/1997 Hill ..... B26B 21/446 30/41.5
5,933,961 A * 8/1999 Oakey ..... B26B 19/44 30/41
D439,702 S 3/2001 Sulik
6,594,905 B2 * 7/2003 Furst ..... B26B 19/40 30/41
6,754,958 B2 6/2004 Haws
6,964,097 B2 11/2005 Franzini
7,234,240 B2 * 6/2007 Peter ..... B26B 19/40 222/400.5
8,220,156 B2 * 7/2012 Forsdike ..... B26B 21/446 30/346.58
8,607,458 B2 12/2013 Hosseini
2002/0004986 A1 * 1/2002 Furst ..... B26B 19/40 30/41.5
2002/0029478 A1 * 3/2002 Haws ..... B26B 21/446 30/41.5
2005/0144784 A1 * 7/2005 Ibuki ..... B26B 19/28 30/41

(Continued)

FOREIGN PATENT DOCUMENTS

WO 2015066391 5/2015

*Primary Examiner* — Kenneth E Peterson

(57) ABSTRACT

The shaving razor is a battery-operated electric razor with an internal water supply and vacuum subsystem. The razor may shave hair using one or more blades having reciprocating cutting edges behind foil shields. The internal water supply may be used to spray water from a water reservoir within the razor through a manifold next to the blades onto the skin and hair to soften the hair. A sponge adjacent to the blades may soak up excess water as well as moisten the skin. The vacuum system operates to suck hair clippings into a collection compartment within the razor. The collection compartment hinges open to be emptied.

13 Claims, 3 Drawing Sheets

(56) References Cited

U.S. PATENT DOCUMENTS

| | | | | |
|---|---|---|---|---|
| 2008/0072437 | A1* | 3/2008 | Michel | A45D 24/22 30/201 |
| 2009/0218252 | A1* | 9/2009 | Michel | A45D 24/22 206/581 |
| 2010/0095529 | A1* | 4/2010 | Hawes | B26B 19/40 30/41.5 |
| 2015/0290821 | A1 | 10/2015 | Manshoory | |
| 2016/0307712 | A1* | 10/2016 | Nishimura | G06F 3/023 |

* cited by examiner

SHAVING RAZOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal grooming, more specifically, a shaving razor.

SUMMARY OF INVENTION

The shaving razor is a battery-operated electric razor with an internal water supply and vacuum subsystem. The razor may shave everywhere needed, using one or more blades having reciprocating cutting edges behind foil shields. The internal water supply may be used to spray water from a water reservoir within the razor through a manifold next to the blades onto the face and hair to soften the hair. A sponge adjacent to the blades may soak up excess water. The vacuum system operates to such hair clippings into a collection compartment within the razor. The collection compartment hinges open to be emptied.

An object of the invention is to provide a battery-operated electric razor for shaving hair where needed.

Another object of the invention is to provide a water subsystem that may spray water from a reservoir within the razor through a manifold next to the blades onto the skin and hair.

A further object of the invention is to provide a vacuum subsystem to suck hair clippings into a collection compartment.

Yet another object of the invention is to provide operator controls to turn the blades and vacuum on or off and to cause the water to spray.

These together with additional objects, features and advantages of the shaving razor will be readily apparent to those of ordinary skill in the art upon reading the following detailed description of the presently preferred, but nonetheless illustrative, embodiments when taken in conjunction with the accompanying drawings.

In this respect, before explaining the current embodiments of the shaving razor in detail, it is to be understood that the shaving razor is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shaving razor.

It is therefore important that the claims be regarded as including such equivalent construction insofar as they do not depart from the spirit and scope of the shaving razor. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
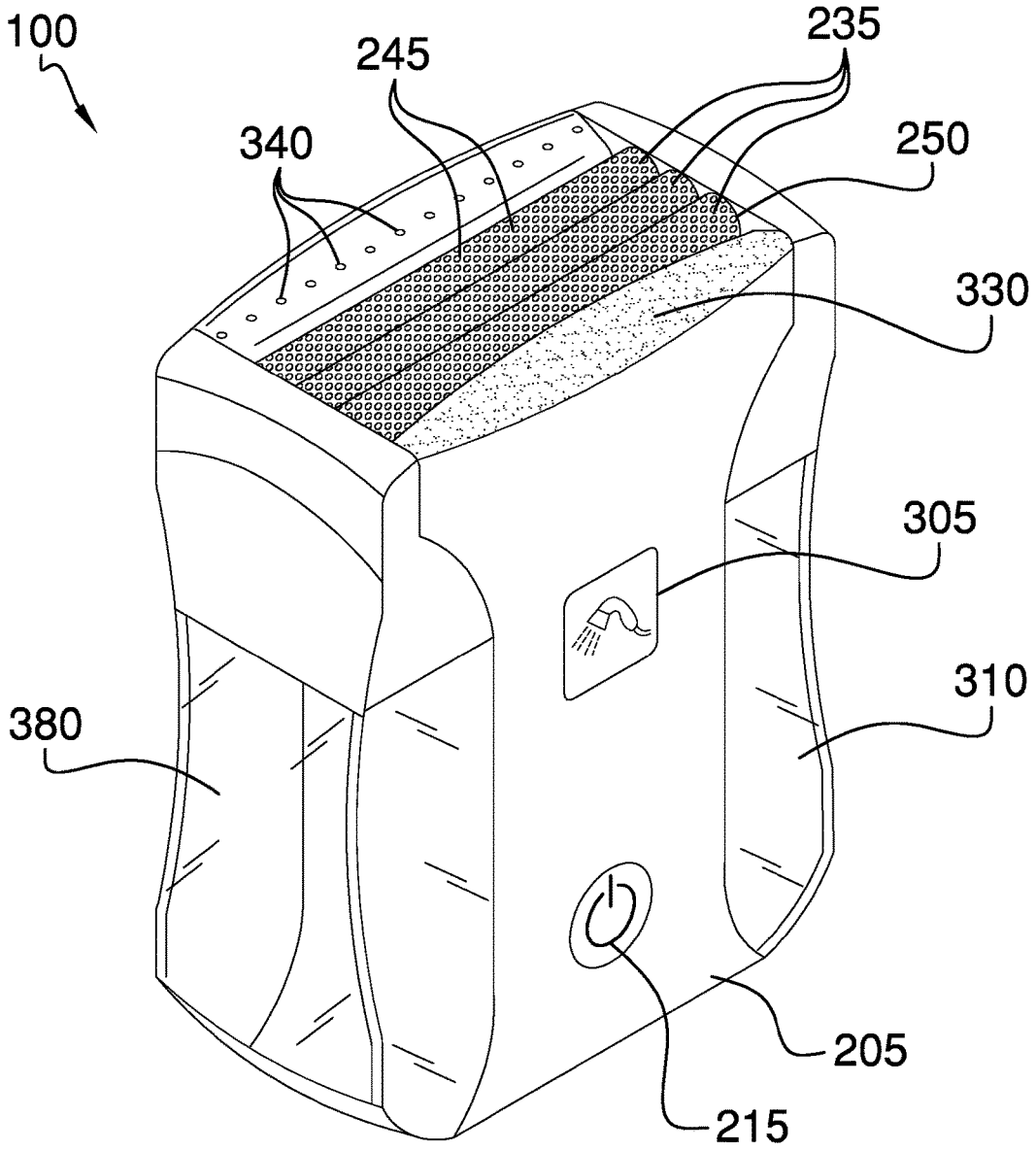
FIG. 1 is a perspective view of an embodiment of the disclosure.
Figure 2:
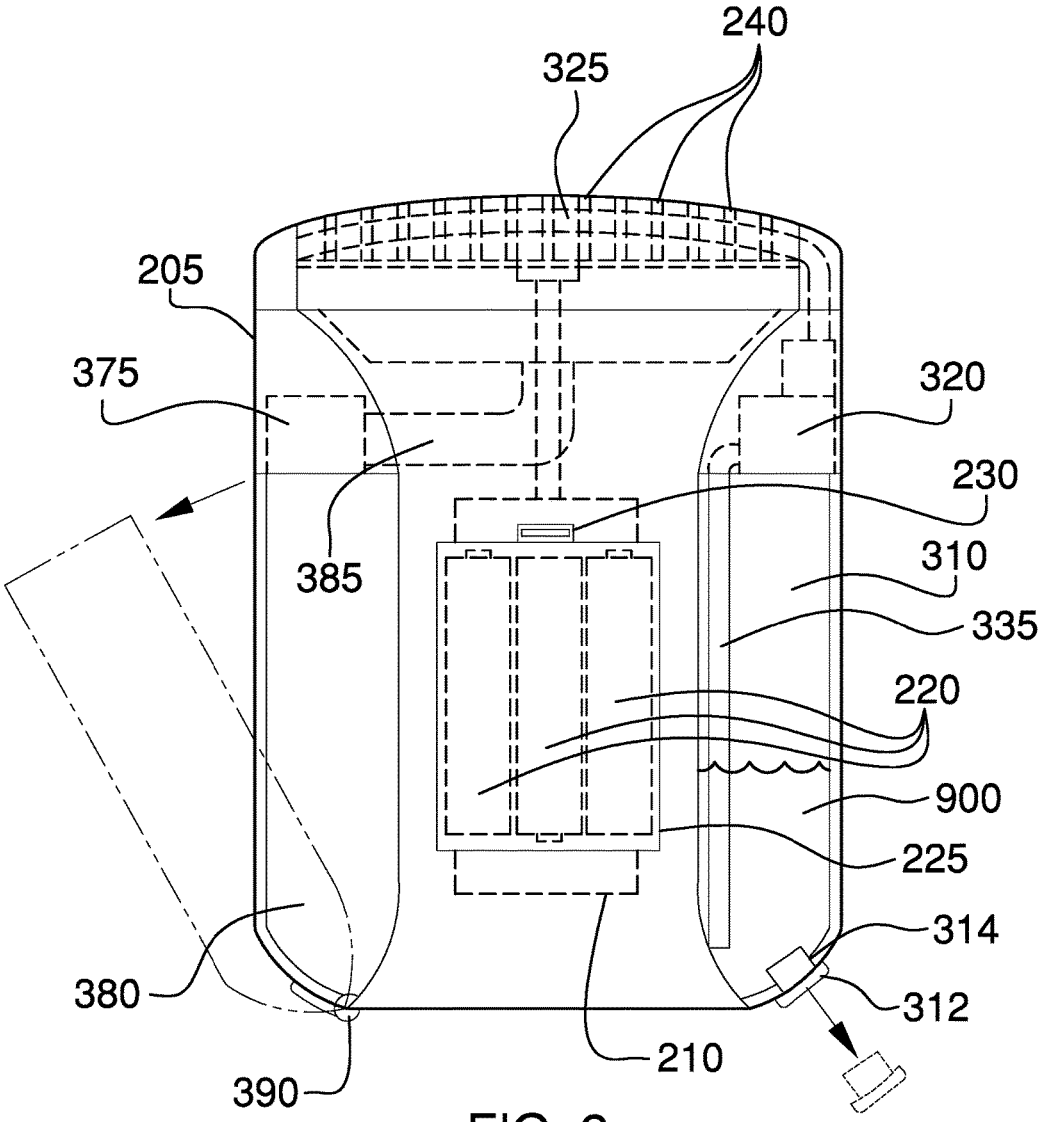
FIG. 2 is a rear view of an embodiment of the disclosure.
Figure 3:
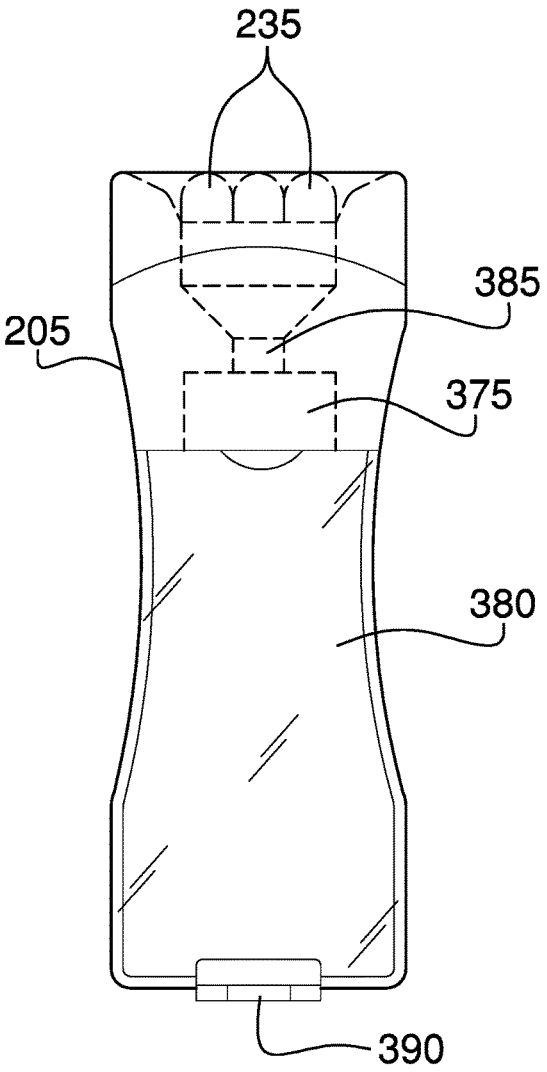
FIG. 3 is a left side view of an embodiment of the disclosure.
Figure 4:
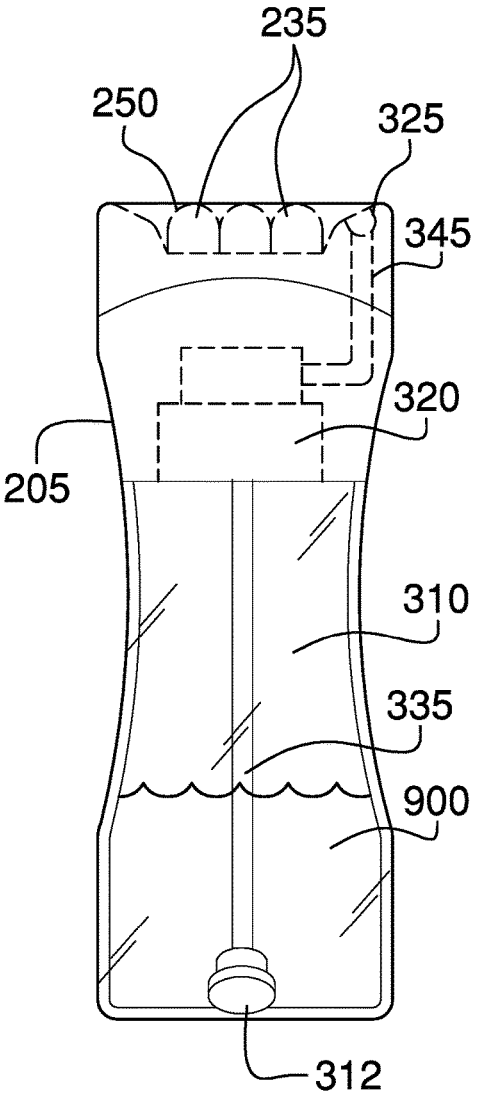
FIG. 4 is a right side view of an embodiment of the disclosure.

Detailed reference will now be made to a first potential embodiment of the disclosure, which is illustrated in FIGS. 1 through 4.

The shaving razor 100 (hereinafter invention) comprises an electric razor, a water supply, and a vacuum subsystem. The invention 100 is an electric shaver with the water supply for moistening the skin and the vacuum subsystem. The vacuum subsystem may collect water 900 and clippings.

The electric razor comprises a razor body 205, one or more blades 235, a motor 210, a blade control 215, one or more batteries 220, a battery compartment 225, and a battery door 230. The electric razor utilizes the one or more blades 235 to cut facial hair.

The razor body 205 may be an enclosure for the motor 210, the one or more blades 235, the one or more batteries 220, the water supply, and the vacuum subsystem. A water reservoir 310 may be coupled to the left side of the razor body 205 and a collection compartment 380 may be hingedly coupled to the right side of the razor body 205. The one or more blades 235 may be located on the top of the razor body 205 such that they are exposed for cutting the hair where needed.

The one or more blades 235 may be laterally oriented on the top surface of the razor body 205. Each of the one or more blades 235 may be parallel to the others if there is more than one of the one or more blades 235.

Each of the one or more blades 235 may comprise a plurality of cutting edges 240 under a foil shield 250. Each of the one or more blades 235 may shave the hair by allowing the hair to pass through foil apertures 245 where a lateral reciprocating motion of the plurality of cutting edges 240 may cause one of the plurality of cutting edges 240 to cut the hair on the inside of the foil shield 250.

The motor 210 may cause the plurality of cutting edges 240 within each of the one or more blades 235 to move in the lateral reciprocating motion when the motor 210 is activated. The motor 210 may be activated using the blade control 215. As a non-limiting example, the blade control 215 may be a push button control where even numbered depressions of the blade control 215 activate the motor 210 and odd numbered depressions of the blade control 215 deactivate the motor 210. Activation and deactivation of the motor 210 may refer to allowing an electrical potential from the one or more batteries 220 to reach or not reach the motor 210 via the blade control 215, respectively.

The one or more batteries 220 may comprise one or more energy-storage devices. The one or more batteries 220 may be a source of electrical energy to operate the motor 210, a water pump 320, and a vacuum pump 375. The one or more batteries 220 may be replaceable or rechargeable. The one or more batteries 220 may be located within the battery compartment 225 that is accessible through the battery door 230 located on the rear side of the razor body 205.

The water supply comprises the water reservoir 310, the water pump 320, a manifold 325, a sponge 330, and a pump control 305. The water supply may be adapted to spray the water 900 onto skin of a user and onto the hair of the user.

The water reservoir 310 may be a container for holding the water 900. The water reservoir 310 may comprise a fill aperture 314 and a fill cap 312 that may be removed to refill the water reservoir 310. The water reservoir 310 may be refilled by inverting the electric razor, removing the fill cap 312, pouring the water 900 into the fill aperture 314, and replacing the fill cap 312.

The water pump 320 may move the water 900 from the water reservoir 310 to the manifold 325. The water pump 320 may be operated by a pump motor contained within the water pump 320. Application of the electrical potential to the water pump 320 may cause the water pump 320 to draw the water 900 in through an intake tube 335 and force the water 900 out through a plurality of manifold apertures 340 located in the manifold 325. The water 900 may reach the manifold 325 by flowing through a manifold feed tube 345 from the water pump 320 to the manifold 325. The electrical potential may be applied to the water pump 320 when the pump control 305 is pressed.

The manifold 325 may be located on the top, rear of the razor body 205 and may be oriented to run laterally. The manifold 325 may comprise the plurality of manifold apertures 340 that are adapted to point towards the skin of the user when the one or more blades 235 are held against the skin of the user.

The sponge 330 may be located on the top, front of the razor body 205 and may be oriented laterally. The sponge 330 may be adapted to soak up the water 900 that has been sprayed onto the skin.

The vacuum subsystem comprises the vacuum pump 375 and the collection compartment 380. The vacuum subsystem may suck the clippings and the water 900 from the top of the electric razor into the collection compartment 380.

The vacuum pump 375 may move air from a vacuum inlet 385 located below the one or more blades 235 into the collection compartment 380. The vacuum pump 375 may pull the clippings into the collection compartment 380 along with the air. The vacuum pump 375 may be operated by the motor 210 that is used to move the one or more blades 235.

The collection compartment 380 may be a container for collecting the clippings. The collection compartment 380 may pivot at a hinge 390 such that the top of the collection compartment 380 may be exposed to empty the collection compartment 380.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "blade" is a term that is used to describe a wide and flat structure or portion of a larger structure. Non-limiting examples of object which are or which comprise blades may include a knife, a propeller, a shovel, or a cutting edge of a tool or razor.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "hinge" is a device that permits the turning, rotating, or pivoting of a first object relative to a second object.

As used in this disclosure, the word "lateral" refers to the sides of an object or movement towards a side. Lateral directions are generally perpendicular to longitudinal directions. "Laterally" refers to movement in a lateral direction.

As used in this disclosure, a "manifold" is a pipe or chamber having several ports through which liquid or gas is gathered or distributed.

As used in this disclosure, a "motor" refers to a device that transforms energy from an external power source into mechanical energy.

As used in this disclosure, a "pump" is a mechanical or electromechanical device that uses suction or pressure to raise or move fluids, compress fluids, or force a fluid into an inflatable object. As non-limiting examples, fluids may include both liquids, such as water, and gases, such as air.

As used in this disclosure, a "reservoir" refers to a container or containment system that is configured to store a liquid.

As used in this disclosure, a "sponge" is a material, generally with a fibrous structure, that is capable of absorbing and retaining liquids.

As used in this disclosure, a "spray" is a plurality of liquid drops projected from a nozzle.

As used in this disclosure, a "tube" is a hollow cylindrical device that is used for transporting liquids and gases. In this disclosure, the terms inner diameter and outer diameter are used as they would be used by those skilled in the plumbing arts. The line that connects the center of the first base of the cylinder to the center of the second base of the cylinder and is equidistant from the outer surface of the tube for its entire length is referred to as the centerline of the tube. When two tubes share the same centerline they are said to be aligned. When the centerlines of two tubes are perpendicular to each other, the tubes are said to be perpendicular to each other.

As used here, "tubing" refers to a tube that is flexible or resilient.

As used in this disclosure, "vacuum" is used to describe a first space that contains gas at a reduced gas pressure relative to the gas pressure of a second space. If the first space and the second space are connected together, this pressure differential will cause gas from the second space to move towards the first space until the pressure differential is eliminated.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A shaving razor comprising:

an electric razor, a water supply, and a vacuum subsystem;

wherein the shaving razor is an electric shaver with the water supply for moistening the skin and the vacuum subsystem;

wherein the vacuum subsystem collects water and clippings;

wherein the electric razor comprises a razor body, one or more blades, a motor, a blade control, one or more batteries, a battery compartment, and a battery door;

wherein the electric razor utilizes the one or more blades to cut hair;

wherein the razor body is an enclosure for the motor, the one or more blades, the one or more batteries, the water supply, and the vacuum subsystem;

wherein a water reservoir is coupled to a first side of the razor body;

wherein a collection compartment is hingedly coupled to the razor body on a second side of the razor body opposite the first side;

wherein the one or more blades are located on the top of the razor body such that they are exposed for cutting the hair;

wherein each of the one or more blades is parallel to the others if there are more than one of the one or more blades;

wherein each of the one or more blades comprises a plurality of cutting edges under a foil shield;

wherein each of the one or more blades cuts the hair by allowing the hair to pass through foil apertures where a lateral reciprocating motion of the plurality of cutting edges causes one of the plurality of cutting edges to cut the hair on the inside of the foil shield;

wherein the motor causes the plurality of cutting edges within each of the one or more blades to move;

wherein the motor is activated using the blade control;

wherein the blade control is a push button control where even numbered depressions of the blade control activate the motor and odd numbered depressions of the blade control deactivate the motor;

wherein activation of the motor applies an electrical potential from the one or more batteries to the motor;

wherein deactivation of the motor removes the electrical potential from the motor.

2. The shaving razor according to claim 1 wherein the one or more batteries comprise one or more energy-storage devices;

wherein the one or more batteries are a source of electrical energy to operate the motor, a water pump, and a vacuum pump;

wherein the one or more batteries are replaceable or rechargeable.

3. The shaving razor according to claim 2 wherein the one or more batteries are located within the battery compartment that is accessible through the battery door located on the rear side of the razor body.

4. The shaving razor according to claim 3 wherein the water supply comprises the water reservoir, the water pump, a manifold, and a pump control;

wherein the water supply is adapted to spray the water onto skin of a user and onto the hair of the user.

5. The shaving razor according to claim 4 wherein the water reservoir is a container for holding the water;

wherein the water reservoir comprises a fill aperture and a fill cap that is removed to refill the water reservoir;

wherein the water reservoir is refilled by inverting the electric razor, removing the fill cap, pouring the water into the fill aperture, and replacing the fill cap.

6. The shaving razor according to claim 5 wherein the water pump moves the water from the water reservoir to the manifold.

7. The shaving razor according to claim 6 wherein application of the electrical potential to the water pump causes the water pump to draw the water in through an intake tube and forces the water out through a plurality of manifold apertures located in the manifold.

8. The shaving razor according to claim 7 wherein the water reaches the manifold by flowing through a manifold feed tube from the water pump to the manifold;

wherein the electrical potential is applied to the water pump when the pump control is pressed.

9. The shaving razor according to claim 8 wherein the manifold is located on the top, rear of the razor body and is oriented to run laterally;

wherein the manifold comprises the plurality of manifold apertures that are adapted to point towards the skin of the user when the one or more blades are held against the skin of the user.

10. The shaving razor according to claim 9 wherein a sponge is located on the top, front of the razor body and is oriented laterally;

wherein the sponge is adapted to soak up the water that has been sprayed onto the skin.

11. The shaving razor according to claim 10 wherein the vacuum subsystem comprises the vacuum pump and the collection compartment;

wherein the vacuum subsystem sucks the clippings and the water from the top of the electric razor into the collection compartment.

12. The shaving razor according to claim 11 wherein the vacuum pump moves air from a vacuum inlet located below the one or more blades into the collection compartment;

wherein the vacuum pump pulls the clippings into the collection compartment along with the air.

13. The shaving razor according to claim 12 wherein the collection compartment is a container for collecting the clippings;

wherein the collection compartment pivots at a hinge such that the top of the collection compartment is exposed to empty the collection compartment.

* * * * *